United States Patent [19]

Kille et al.

[11] Patent Number: 4,982,899

[45] Date of Patent: Jan. 8, 1991

[54] DEVICE FOR REGULATING DISCHARGE VOLUMES OF A NOZZLE

[75] Inventors: Ewald Kille; Heinrich Griebel, both of Friedrichshafen, Fed. Rep. of Germany

[73] Assignee: J. Wagner, GmbH, Fed. Rep. of Germany

[21] Appl. No.: 368,590

[22] Filed: Jun. 20, 1989

[30] Foreign Application Priority Data

Jun. 23, 1988 [DE] Fed. Rep. of Germany ..... 3821212

[51] Int. Cl.[5] ..... B05B 1/30

[52] U.S. Cl. ..... 239/329; 239/569

[58] Field of Search ..... 239/572, 569, 332, 104, 239/119, 531, 333, 334; 222/282, 319, 330

[56] References Cited

U.S. PATENT DOCUMENTS

| | | | |
|---|---|---|---|
| 3,118,611 | 1/1964 | Berlyn | 239/119 |
| 4,516,702 | 5/1985 | Schmidt | 222/571 X |
| 4,558,821 | 12/1985 | Tada et al. | 239/333 |
| 4,735,362 | 4/1988 | Trautwein et al. | 239/127 |

FOREIGN PATENT DOCUMENTS

| | | |
|---|---|---|
| 1646190 | 8/1971 | Fed. Rep. of Germany . |
| 3621965 | 12/1986 | Fed. Rep. of Germany . |

*Primary Examiner*—Andres Kashnikow
*Assistant Examiner*—Kevin P. Weldon
*Attorney, Agent, or Firm*—Hill, Van Santen, Steadman & Simpson

[57] ABSTRACT

A device for controlling the quantity of a medium, such as paint, lacquer or adhesive emerging from a discharge nozzle of an equipment, such as a spray gun, which device includes a delivery chamber extending between the discharge nozzle and a pump housing which has a pump chamber connected at one end by an outlet valve to the delivery chamber and receives a reciprocating pump piston, with the delivery chamber including a control arrangement that will adjust the quantity of the medium flowing through the discharge nozzle and also prevent a dribble from the end of the nozzle during a return stroke of the pump piston. The control arrangement includes a control sleeve which telescopically receives the control piston that moves with the valve member of the outlet valve relative to the sleeve and the sleeve and control piston have a flow restricting arrangement, such as formed by a groove having a different cross sectional size in the axial direction so that the size of the opening will change as the control piston moves relative to the control sleeve.

19 Claims, 2 Drawing Sheets

DEVICE FOR REGULATING DISCHARGE VOLUMES OF A NOZZLE

BACKGROUND OF THE INVENTION

The present invention is directed to a device for regulating the quantity of a pressurized fluid or paste-like medium, such as paint, lacquer, adhesive or the like, which mediums emerging from a discharge nozzle of an equipment, for example a spray gun. The device includes a feed pump having a pump chamber which receives a pump piston that is driven in oscillation. The pump chamber is connected by a suction line to a reservoir for the medium and has an outlet valve actuated by the prevailing pressure in the pump chamber for conveying the medium into a delivery chamber which is positioned before the discharge nozzle of the device.

U.S. Pat. No. 4,735,362, which claims priority from German Patent Application No. 35 29 909, and whose disclosure is incorporated by reference thereto, discloses a device having a quantitatively-controlled discharge of a medium of the above-mentioned type. In the device of this patent, the pump chamber receives a piston, which is oscillated to create a pressure in the medium contained in the chamber to force it out of an outlet valve into a delivery chamber which is connected to a discharge nozzle, which, in turn, has a second valve, which is opened by the pressure created in the delivery chamber. The second valve, whose closing element is closed by pressure of a spring, is provided in the delivery chamber to insure that the medium is discharged only if sufficient pressures prevail in the delivery chamber to obtain the desired atomization. Accordingly, the second valve is constructed so that the opening pressure is significantly higher than that of the pump outlet valve. In this device, there is also an adjustable flow control valve connected to the delivery chamber by means of which the pre-loading of the valve spring of the second valve, the stroke of the pump piston, and the paint flow can be adjusted. Thus, the medium not flowing out of the nozzle is returned to the reservoir via the flow control valve. German No. OS 16 46 190 and German No. OS 36 21 965 also disclose the regulation of the paint flow by means of valves received in return pipes.

In all of these examples of the prior art, excess medium delivered by the pump piston but not ejected through the nozzle is returned to the reservoir. Not only does this necessitate the provision of constructional measures, which require return pipes, flow restrictors, valves and the like to be incorporated in the feed pump, but often the medium, which is sometimes recirculated by the pump several times, is thereby damaged and may foam. This, in turn, will detrimentally affect the output of the pump and also will impair the spray pattern. Moreover, the measures, such as these, take direct intervention in the equipment and cannot be readily used with other equipment.

SUMMARY OF THE INVENTION

An object of the present invention is to create a device of the above-mentioned type, by means of which the quantity of the medium flowing out of the nozzle may be simply controlled and indefinitely adjusted within a wide range between a maximum and minimum quantity without impairing the output of the pump and/or the degree of atomization. Above all, no excess medium delivered by the pump should be returned to the reservoir and, thus, be damaged. Instead, the medium should remain in the pump chamber and/or the delivery chamber and also adjustments of the quantity of the medium to be discharged should be easily obtained manually in a short time and the device should be capable of being fitted to similar equipment without special measures being required.

According to the invention, this is achieved in an improvement of a device for regulating the quantity of a pressurized fluid or paste-like medium, such as paint, lacquer or adhesive and the like, which emerges from a discharge nozzle of the equipment, for example a spray gun. The device comprises a feed pump with a pump chamber receiving a pump piston drivable in oscillation, said pump chamber being connected by a suction line to a reservoir for the medium to be discharged and has an outlet valve actuated by the prevailing pressure in the chamber for discharging into a delivery chamber positioned before a discharge nozzle which is connectible with the pump chamber via the outlet valve. The improvements are control means for adjusting the quantity of the medium flowing through the discharge nozzle including a control sleeve being axially adjustably arranged in the delivery chamber and a control piston coacting therewith being inserted into the delivery chamber, said control piston being axially movable by a positive connection with a valve plunger or member of the outlet valve against a force of a return spring and that one of the control sleeve and control piston is provided with one or more flow restricting apertures with the opening area being adjustable in order to adjust the quantity of the medium flowing through the discharge nozzle and is automatically variable by movement of the control piston relative to the control sleeve, depending on the position of the valve member of the outlet valve.

For this, it is expedient for the control piston to be axially movably received in the control sleeve and for it to be positively connected to the plunger of the outlet valve by a rod.

For adjustment of the axial position of the control sleeve, it is advantageous for the sleeve to be received in or be rigidly connected to a sleeve-like adjustment element which is arranged in alignment with the pump housing and is axially movable relative thereto.

To this end, the adjustment element can be either directly connected or indirectly connected via an intermediate element, and be adjustable by means of screw threads, which are connected to the pump housing. Then the adjustment element can be rigidly connected to the pump housing by means of the intermediate element in the form of a sleeve nut which is provided with internal screw threads and which partially encloses the adjusting element.

It is also advantageous for the travel of the adjustment element to be limited by means of a spring ring, which is inserted in a groove formed in the internal screw threads of the sleeve nut. In addition, it is desirable for an axially loadable sleeve to be interposed between the sleeve nut and the pump housing in the vicinity of the control sleeve.

The flow restricting apertures formed in the control sleeve and/or the control piston can be simply formed by axially extending tapered recesses, incisions, through apertures or the like with a cross sectional areas which vary along their axial length. The flow restricting apertures may be manufactured at a low cost if they take the form of tapered recesses formed in an outer surface of the control piston and coverable by the control sleeve when the control piston is moved axially within the sleeve.

It is also expedient for the return spring to act on a spring collar or abutment which, in turn, abuts against the control piston, directly or through an intermediate element arranged between the collar and control piston. This collar provides means for restricting comprising an annular gap, one or more restricting orifices or the like which will provide a constant flow resistance. With the help of this flow restrictor, dribbles at the discharge nozzle during the return stroke of the pump piston can, thus, be reliably prevented.

In addition, the spring collar may be axially movably received in an internal cavity within the adjustment element by means of a guide element which, preferably, has a cruciform cross section to provide outer axial grooves and is arranged between the spring collar and control piston. The spring collar has a stepped push rod that extends through an axial bore of the guide to engage the control piston.

The discharge nozzle, which should preferably be provided with a swirl head, can be screwed onto the adjustment element. The return spring can be supported against the discharge nozzle directly or via an intermediate element and the adjustment element should also be provided with a grip, for example in the form of a knurled collar.

Other advantages and features of the invention will be readily apparent from the following description of the preferred embodiments, the drawings and the claims.

DESCRIPTION OF THE PREFERRED EMBODIMENTS

Figure 1:
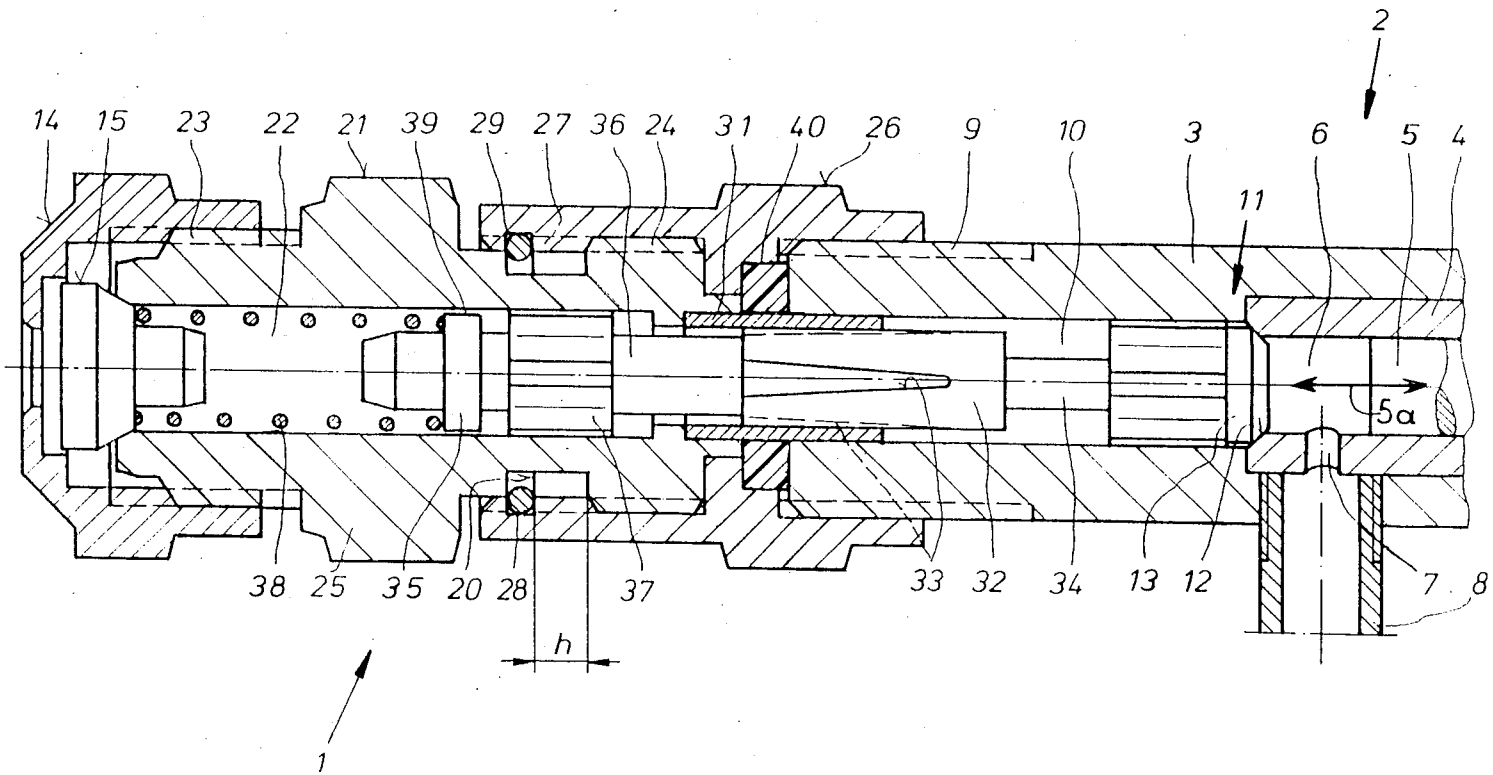
FIG. 1 is a longitudinal cross sectional view with portions in elevation for purposes of illustration of a pump housing in accordance with the present invention.

The principles of the present invention are particularly useful when incorporated in a device for regulating the quantity of pressurized fluid or paste-like medium, such as paint, lacquer, adhesive or the like, which device is generally indicated at 1 in FIG. 1. The device 1 serves to control the quantity of the medium delivered by a feed pump, generally indicated at 2, which will flow out a discharge nozzle 14 as an atomized spray, which nozzle is associated with the pump 2 and the atomized spray will not have the degree of atomization impaired.

The feed pump 2 comprises a pump housing 3 which has an inserted sleeve or hollow barrel 4 providing a pump chamber 6. A pump piston 5 is movably received in the chamber 6 of the sleeve or barrel 4 and is drivable in an oscillation by an oscillating-armature electric motor, which is conventional and not shown, with If equipment having a discharge nozzle is equipped with a device according to the present invention, it is possible in a very simple way to control the quantity of the medium delivered by the pump which is ejected from the discharge nozzle and to infinitely vary this quantity within a wide range without the spray pattern and/or the medium being impaired by repeated recirculation through the pump. If a flow restrictor with an opening area which is adjustable and is variable during operation is introduced before the discharge nozzle, then the quantity delivered at any time can be adjusted without difficulty, without part of the medium being returned to the reservoir and without a corresponding constructional measurement being required. Rather, the medium pushed into the delivery chamber by the pump piston but not ejected through the discharge nozzle remains in the flow restrictor chamber and/or it is returned to the pump chamber by the flow restrictor piston, so that it is not necessary to integrate components into the pump. On the contrary, the device, as proposed, can be mounted on the pump housing without difficulty so that even equipment already in operation can be retrofitted or equipped with such a device to enable the quantity of the medium discharge to be adapted to the prevailing circumstances.

It is also advantageous that the help of the additionally-provided flow restrictor with a constant flow resistance, a dribble at the discharge nozzle can be reliably avoided, and that the device is easy to operate. In this way, the function of the hand spray guns can be substantially improved with little constructional complexity and the quantity of the medium to be atomized is maintained. the movement being indicated by a double arrow 5a. The pump chamber 6 is connectible to a reservoir (not shown) via an intake port 7 in the sleeve 4, which port 7 is in communication with a suction line 8 extending to the reservoir.

The pump chamber 6 terminates in an outlet valve, generally indicated at 11, which connects the chamber 6 to a delivery chamber 10 whenever the valve is opened, in view of the pressure in the chamber 6. The outlet valve 11 comprises a valve seat 12 which is formed on an edge of the sleeve 4 and a valve member 13 which is axially movably received in the delivery chamber 10 and which acts in cooperation with the valve seat 12.

The delivery chamber 10 also receives a control sleeve 31, which telescopically receives a control piston 32 which is slidably mounted in the sleeve 31 and which is positively connected to the valve member 13 of the outlet valve 11 by a rod portion 34. The control sleeve 31 is rigidly connected to a sleeve-like adjustment element 21 which is secured to the pump housing 3 by means of a sleeve nut 26. To this end, the adjustment or adjusting element 21 is provided with an external thread 24 at its end nearest the pump housing 3 and the sleeve nut 26 is provided with an associated internal thread 27 into which the adjustment element 21 is threaded or screwed. The sleeve nut 26 is secured to the pump housing 3 by means of internal threads being threaded on external threads 9 of the housing 3.

The adjustment element 21, at an end opposite the feed pump 2, is also provided with external threads 23 onto which is threaded a discharge nozzle 14, which is equipped with a swirl head 15. Between the two screw threads 23 and 24, the adjustment element 21 has a grip portion 25, which is illustrated as being formed of a knurled collar, which enables the element 21 to be adjusted easily by hand to change the amount of threading between the threads 24 and 27 to change the axial position of the element 21 relative to the housing 3.

To limit the travel h of the adjustment element 21, a groove 28 is formed in the internal threads 27 of the sleeve nut 26. The groove 28 receives a spring ring 29.

The adjustment element 21 can, thus, be moved to the left until it will abut against this spring ring 29, which will then limit the movement towards the left, as illustrated in FIG. 1.

In the embodiment shown, at least one tapered flow restricting aperture 33 is formed on the control piston 32, which aperture extends in the axial direction of the control piston 32 and are covered by the control sleeve 31 when the valve member 13 of the outlet valve 11 is moved towards the left by a certain amount. The apertures 33 are preferably in the form of recesses which are cut in an outer surface of the control piston 32 and are reduced to approximately the same diameter as a push rod 36, which is supported against the control piston 32. The push rod 36, at an end opposite the end abutting the control piston 32, is provided with an annular collar or spring collar 35. In order to position and guide the rod 36 with the collar 35 in an internal cavity 22 of the element 21, a guide element 37 having axial grooves to form a cruciform cross section is arranged between the collar 35 and the piston 32 and has a bore which slidably receives the rod 36.

A spring 38 is positioned between the spring collar 35 and the swirl head 15 and biases the rod 36 with the collar 35 against the control piston 32 to, in turn, bias the valve member 13 against the seat 12. To form a seal at a point in which the adjustment element 21 is connected to the pump housing 3, a seal 40 is interposed between the sleeve nut 26 and the pump housing 3 in the vicinity of the control sleeve 31, and this seal is axially loaded.

If the feed pump 2 is set into operation, the pump piston 5 will first move from adjacent the valve member 13 towards the right and, as it moves over the port 7, will cause a medium in the suction line 8 to be drawn through the port 7 into the pump chamber. On the reversed movement towards the left in FIG. 1, the piston 5, after it covers the port 7, will begin to compress the medium between the end of the piston 5 and the valve member 13. As soon as the pressure prevailing in the pump chamber 6 is greater than the opposing forces of the return spring 38, the outlet valve 11 will open and the medium will flow through the valve 11 into the delivery chamber 10. In this operating condition, the medium can also pass through the flow restricting apertures 33 of the control piston 32 into the internal cavity 22 of the adjustment element 21, which cavity 22 is a portion of the delivery chamber on the left hand side, as illustrated in FIG. 1.

However, since the valve member 13 and the control piston 32 are rigidly connected to each other by the rod 34, a continual movement of the member 13 to the left will cause the control piston 32 to be inserted into the control sleeve 31 until the flow restricting apertures 33 are completely covered to be closed or shut off. The pressure in the pump chamber 6 and a portion of the delivery chamber 10 to the right of the control piston 32 will rise sharply, since the medium can no longer flow out, so that a high pressure is exerted via the control piston 32 onto the medium in the internal or inner cavity 22 of the adjustment element 21, and this medium is fed through the swirl head 15 to the discharge nozzle 14. When the flow restricting apertures 33 are closed and the outlet valve 11 is open, the medium in the pump chamber 6 and the right hand portion of the delivery chamber 10 acts as it were as a hydraulic linkage, and the medium fed into the inner cavity 22 of the adjustment element 21 is then ejected at high pressure in a short time.

During the return stroke of the pump piston 5, a depression is created in the pump chamber 6 and, as long as the outlet valve 11 is open, also in the right hand portion of the delivery chamber, 10.

Since the spring collar 35 and the control piston 32 are also pushed to the right by the loaded return spring 38, a depression will also come into being in the left part of the internal cavity 22 due to the gap 39 between the outer surface of the collar 35 and the inner surface of the cavity 22, which gap acts as a flow restrictor. The medium is sucked inward out of the discharge nozzle 14 by this drop in pressure, and the ejection of the medium is, thus, abruptly interrupted.

Since the spring collar 35 is provided with the flow resistor of a constant flow resistance in the form of the annular gap 39, the depression in the forward portion of the internal cavity 22 is maintained for a relatively long period, due to the delay compensating flow of the medium and, in this way, dribbling at the discharge nozzle 14 is reliably prevented. The opening area of the annular gap 39 is only minimally greater than is necessary to allow the passage of the maximum output of the pump, which is limited by the flow restricting apertures 33. Since the pump piston 6 and the components associated therewith perform up to 7200 strokes per minute, the cycles of movement are each executed in a very short time.

Figure 2:
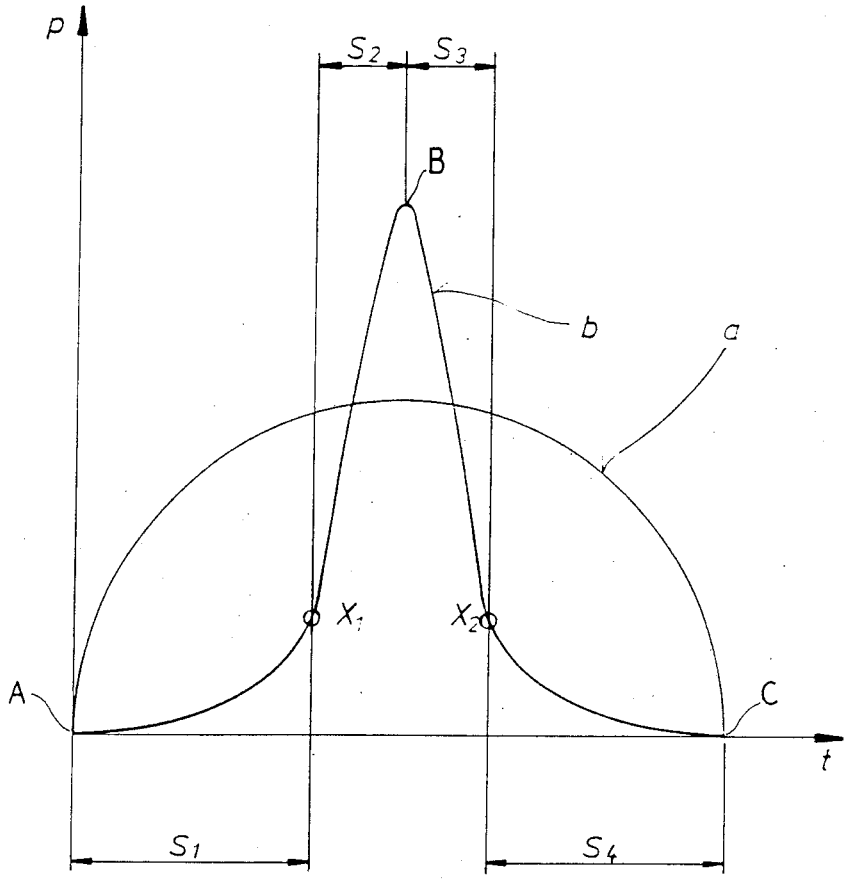
FIG. 2 is a graph of the pressure versus time during one piston stroke in the pump chamber of the device of FIG. 1.

The diagram of FIG. 2 shows the pressure variations in the pump chamber 6 over one unit of time. The curve a is of a half wave of the alternating current connected to the drive motor of the feed pump 2 and the curve b shows the variation in pressure along the time axis during one stroke of the pump piston 5 from point A closing the port 7 to a point B with a maximum displacement toward the valve seat 12 and back to a point C at which the port 7 is uncovered. It can be seen from curve b that the pressure in the pump chamber 6 rises gradually during a time S1, while the flow restriction aperture 33 remains open. At point Xl, the flow restricting aperture 33 is closed and the build-up pressure takes place very quickly during the time S2 with the flow restriction apertures 33 closed. During the time S3, the pressure is reduced again in the same manner until the flow restricting apertures 33 are open at point X2. During the time S4, the pressure again drops gradually back to the initial level.

Control and, thus, adjustment of the quantity of the medium delivered by the pump 2, which is emitted from the discharge nozzle 14, is affected by changing the position of the control sleeve 31 by means of the adjustment element 21, which forms means for mounting the sleeve 31. By turning the adjustment element 21, the control sleeve 31 is axially displaced so that the effective maximum opening area of the flow restriction aperture 33 will be altered. The quantity emitted at any one time will be determined by the maximum opening area of the flow restriction aperture 33.

Thus, by means of the device 1, the quantity and the medium to be atomized of to flow out of the discharge nozzle 14 may be varied in a simple way without the need for the quantity of the unatomized medium delivered by the pump 2 to be returned to the reservoir. The delivery chamber and cavity 22 are not connected to any return line for the reservoir.

Although various minor modifications may be suggested by those versed in the art, it should be understood that we wish to embody within the scope of the patent granted hereon all such modifications as reasonably and properly come within the scope of our contribution to the art.

We claim:

1. In a device for regulating the quantity of pressurized medium emerging from a discharge nozzle of equipment, said device comprising means forming a delivery chamber disposed between the discharge nozzle and a feed pump, said feed pump having a pump housing with a pump chamber receiving a pump piston drivable in oscillation, said pump chamber having a port connected to a suction line extending to a reservoir of the medium and said pump chamber having an outlet valve with a movable valve member for communicating the pump chamber to said delivery chamber, the improvement comprising control means for adjusting the quantity of a medium flowing through the discharge nozzle including a control sleeve and a control piston, mounting means for axially adjustably arranging said sleeve in said delivery chamber, said control piston being received in said delivery chamber and coacting with said sleeve, said control piston having a positive connection with the valve member of the outlet valve and being movable with the valve member of the outlet valve against the spring means biasing the valve member of the outlet valve to a position to close said outlet valve, said control means between the control sleeve and control piston being provided with a flow restricting aperture having an opening area which is adjustable in order to adjust the quantity of the medium flowing therethrough, the opening area of said aperture automatically being varied by movement of the control piston with the valve member relative to the control sleeve.

2. In a device according to claim 1, wherein the control piston is axially movably received in said control sleeve.

3. In a device according to claim 2, wherein the positive connector between the control piston and the valve member of the outlet valve is a rod.

4. In a device according to claim 1, wherein the mounting means is a sleeve-like adjustment element, said control sleeve being rigidly connected to said adjustment element, which is arranged in alignment with the pump housing and is axially movable relative thereto to shift the axial position of the control sleeve in said delivery chamber.

5. In a device according to claim 4, wherein the adjustment element is adjustably connected to the pump housing by an intermediate element having screw threads.

6. In a device according to claim 4, wherein the adjustment element is rigidly connected to the pump housing by means of an intermediate element in the form of a sleeve nut, said sleeve nut being provided with internal screw threads partially enclosing the adjustment element.

7. In a device according to claim 6, wherein the adjustment element and sleeve nut have means for limiting the amount of travel therebetween and including a groove formed in the internal threads of the sleeve nut receiving a spring ring.

8. In a device according to claim 6, which includes an axially compressible seal being interposed between the sleeve nut and the pump housing in the vicinity of the control sleeve.

9. In a device according to claim 1, wherein the flow restricting aperture is an axially extending opening having a cross sectional area varying along the axial length of the opening.

10. In a device according to claim 9, wherein the flow restricting aperture is in the form of a tapered recess formed on a surface of the control piston, said recess being coverable by the control sleeve when the control piston is moved axially into said control sleeve.

11. In a device according to claim 1, wherein the spring means comprises a spring acting between the discharge nozzle and a spring collar disposed in said delivery chamber, said spring collar abutting against the control piston to bias the piston and valve member toward the closed position of said outlet valve.

12. In a device according to claim 11, which includes means forming a second flow restrictor for restricting flow past said collar in said delivery chamber.

13. In a device according to claim 12, wherein the means forming a second flow restrictor comprises an annular gap between the spring collar and an inner surface of the delivery chamber.

14. In a device according to claim 12, wherein said means forming a second flow restrictor includes at least one restricting orifice extending through said spring collar to provide a constant flow resistance.

15. In a device according to claim 1, which includes a guide element interposed between said spring collar and said control piston, said guide element having at least one outer axially extending groove and an axial bore, said spring collar having a push rod slidably received in said axial bore for contacting an end of said control piston.

16. In a device according to claim 1, wherein the discharge nozzle includes a swirl head, said discharge nozzle being threaded onto an adjustment element of the mounting means, said spring means engaging said swirl head of said discharge nozzle.

17. In a device according to claim 1, wherein an adjustment element of the mounting means is provided with a grip in the form of a knurled collar.

18. In a device for regulating the quantity of pressurized medium emerging from a discharge nozzle of a spray gun, said device comprising means forming a delivery chamber disposed between the discharge nozzle and a feed pump, said feed pump having a housing with a pump chamber receiving a pump piston driven in oscillation, said pump chamber having aport connected to a suction line extending to a reservoir for the medium and said pump chamber having an outlet valve with a valve member for communicating the pump chamber to said delivery chamber, the improvements comprising said delivery chamber having only an outlet in communication with said nozzle and an inlet in communication with said valve, said delivery chamber including control means for adjusting the quantity of the medium flowing through the discharge nozzle, said control means including a control sleeve and a control piston, means for axially adjustably positioning the control sleeve in said delivery chamber, said control piston being connected by a rod to the valve member for movement therewith and being telescopically received within said control sleeve, spring means biasing the control piston and valve member axially to a position to close said outlet valve, said control means between the control sleeve and control piston having a flow restricting aperture having a variable cross section along an axial direction so that relative movement between the control piston and control sleeve changes the amount of medium passing along said flow restricting aperture.

19. In a device according to claim 18, which includes means forming an additional flow restrictor between said control piston and said discharge nozzle.

* * * * *